US010519761B2

(12) United States Patent
Patel

(10) Patent No.: US 10,519,761 B2
(45) Date of Patent: Dec. 31, 2019

(54) SYSTEM AND METHODOLOGY FOR MONITORING IN A BOREHOLE

(71) Applicant: Schlumberger Technology Corporation, Sugar Land, TX (US)

(72) Inventor: Dinesh Patel, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 138 days.

(21) Appl. No.: 15/027,171

(22) PCT Filed: Oct. 3, 2014

(86) PCT No.: PCT/US2014/058979

§ 371 (c)(1),
(2) Date: Apr. 4, 2016

(87) PCT Pub. No.: WO2015/051222

PCT Pub. Date: Apr. 9, 2015

(65) Prior Publication Data

US 2016/0237803 A1 Aug. 18, 2016

Related U.S. Application Data

(60) Provisional application No. 61/886,158, filed on Oct. 3, 2013.

(51) Int. Cl.
*E21B 47/00* (2012.01)
*E21B 33/13* (2006.01)
(Continued)

(52) U.S. Cl.
CPC ..... *E21B 47/0005* (2013.01); *E21B 33/0407* (2013.01); *E21B 33/13* (2013.01);
(Continued)

(58) Field of Classification Search
CPC ..... E21B 33/14; E21B 47/06; E21B 47/1005; E21B 47/122; E21B 47/123; E21B 47/0005; E21B 47/0006; E21B 47/065
See application file for complete search history.

(56) References Cited

U.S. PATENT DOCUMENTS 6,374,913 B1 * 4/2002 Robbins ..... E21B 47/122 166/113
6,429,784 B1 * 8/2002 Beique ..... E21B 17/14 166/250.07

(Continued)

OTHER PUBLICATIONS

PCT/US2014/058979, International Search Report and Written Opinion, dated Jan. 13, 2015, 15 pgs.

*Primary Examiner* — Jennifer H Gay

(57) ABSTRACT

A technique facilitates monitoring of parameters along the exterior of a tubing/casing deployed in a borehole. An array of sensors is positioned outside of the tubing/casing and within a borehole wall. The array of sensors is coupled to a surface via a communication line routed through an inductive coupler system. The inductive coupler system has a first inductive coupler member located at an outside position and a second inductive coupler member located at an inside position with respect to the tubing/casing. The arrangement enables real-time monitoring of events outside of the tubing/casing.

15 Claims, 10 Drawing Sheets

(51) Int. Cl.

| | |
|---|---|
| ***E21B 47/06*** | (2012.01) |
| ***E21B 33/04*** | (2006.01) |
| ***E21B 47/10*** | (2012.01) |
| ***E21B 47/12*** | (2012.01) |
| ***E21B 33/14*** | (2006.01) |

(52) U.S. Cl.
CPC ..... *E21B 33/14* (2013.01); *E21B 47/06* (2013.01); *E21B 47/1005* (2013.01); *E21B 47/122* (2013.01); *E21B 47/123* (2013.01); *E21B 47/0006* (2013.01); *E21B 47/065* (2013.01)

(56) References Cited

U.S. PATENT DOCUMENTS 6,515,592 B1 * 2/2003 Babour ..... G01V 11/002 166/66
8,056,619 B2 * 11/2011 Patel ..... E21B 17/028 166/242.7
8,082,990 B2 * 12/2011 Lovell ..... E21B 17/028 166/242.6
8,297,353 B2 * 10/2012 Roddy ..... E21B 33/13 166/250.14
8,505,625 B2 * 8/2013 Ravi ..... E21B 33/14 166/250.14
8,881,843 B2 * 11/2014 Todd ..... E21B 17/01 166/267
9,175,560 B2 * 11/2015 Algeroy ..... E21B 47/122
9,249,559 B2 * 2/2016 Dyer ..... E03B 3/14
9,864,095 B2 * 1/2018 Choi ..... G01V 8/16
2002/0149499 A1 * 10/2002 Beique ..... E21B 17/14 340/854.5
2002/0179301 A1 * 12/2002 Schultz ..... E21B 7/061 166/250.01
2003/0058127 A1 * 3/2003 Babour ..... G01V 11/002 340/854.3
2007/0227727 A1 * 10/2007 Patel ..... E21B 17/028 166/250.01
2007/0235185 A1 * 10/2007 Patel ..... E21B 17/028 166/250.01
2008/0041576 A1 * 2/2008 Patel ..... E21B 17/028 166/65.1
2009/0066535 A1 * 3/2009 Patel ..... E21B 17/028 340/853.2
2009/0211755 A1 8/2009 Dyer et al.
2009/0236144 A1 * 9/2009 Todd ..... E21B 17/01 175/5
2010/0101786 A1 * 4/2010 Lovell ..... E21B 17/028 166/250.01
2011/0192598 A1 * 8/2011 Roddy ..... E21B 33/13 166/253.1
2011/0308788 A1 * 12/2011 Ravi ..... E21B 33/14 166/250.01
2012/0013893 A1 * 1/2012 Maida ..... E21B 47/123 356/73.1
2013/0075087 A1 * 3/2013 Algeroy ..... E21B 47/00 166/250.01
2013/0081807 A1 * 4/2013 Dyer ..... E03L 33/14 166/254.2
2013/0175094 A1 7/2013 Ross et al.
2013/0192851 A1 * 8/2013 Algeroy ..... E21B 47/122 166/382
2013/0269945 A1 * 10/2013 Mulholland ..... E21B 47/122 166/336
2014/0139226 A1 * 5/2014 Jaaskelainen ..... G01V 3/26 324/344
2014/0266210 A1 * 9/2014 Godager ..... G01V 3/34 324/323
2016/0237803 A1 * 8/2016 Patel ..... E21B 33/13
2017/0096888 A1 * 4/2017 Drouet ..... E21B 47/0005

* cited by examiner

SYSTEM AND METHODOLOGY FOR MONITORING IN A BOREHOLE

CROSS-REFERENCE TO RELATED APPLICATIONS

The present document is based on and claims priority to U.S. Provisional Application Ser. No. 61/886,158, filed Oct. 3, 2013, which is incorporated herein by reference in its entirety.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of casing and other well system components may be deployed downhole in the wellbore. In many applications, casing is cemented in place in the wellbore and other completion components are deployed downhole through or into the casing. Sensors may be deployed with the completion components to monitor well related parameters. Signals from the sensors may be transmitted to the surface via communication lines routed along a tool string containing the completion components along the interior of the casing.

SUMMARY

In general, a system and methodology are provided for facilitating monitoring of parameters along the exterior of a tubing/casing deployed in a borehole. An array of sensors is positioned outside of the tubing/casing and within a borehole wall. The array of sensors is coupled to a surface control or other control via an inductive coupler system having a first inductive coupler member located at an outside position and a second inductive coupler member located at an inside position with respect to the tubing/casing. The arrangement enables real-time monitoring of events outside of the tubing/casing. For example, the array of sensors may be used to monitor a cementing operation and curing of the cement.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate monitoring of parameters along the exterior of a tubing/casing deployed in a borehole. A variety of sensors may be used to detect specific parameters, such as temperature, pressure, fluid constituents, seismic signals, and/or other parameters. Certain sensors may be employed to track events occurring downhole, such as the curing of cement after it is flowed into an annulus surrounding a casing during a cementing operation.

According to an example, an array of sensors is positioned outside of a tubing, such as a casing, and within a borehole wall. The array of sensors is coupled to a surface control or other control via an inductive coupler system having a first inductive coupler member located outside of the tubing and a second inductive coupler member located inside the tubing. This allows signals from the array of sensors to cross over from the annulus surrounding the tubing to an interior of the tubing. The arrangement enables real-time monitoring of events outside of the tubing/casing. For example, the array of sensors may comprise temperature sensors used to monitor curing of cement deployed in the annulus during a cementing operation. The sensors also may be used after curing to monitor the integrity of the cement and/or other parameters related to use of the well.

Generally the system and methodology facilitate the use of various types of sensors deployed outside of a casing or other tubular structure. Additionally, a wireless transfer of signals, e.g. power and/or data signals, may occur between the sensors and a control system via an inductive coupler system. In some applications, a plurality of inductive coupler systems can be used to transfer signals across a plurality of tubulars concentrically deployed in a borehole. In this manner, many types of events occurring outside of the casing or other tubing may be monitored in real-time. The system is useful for obtaining data related to a variety of events, including cementing operations, seismic operations, integrity monitoring operations, cross well monitoring operations, and/or other types of operations.

Figure 1:
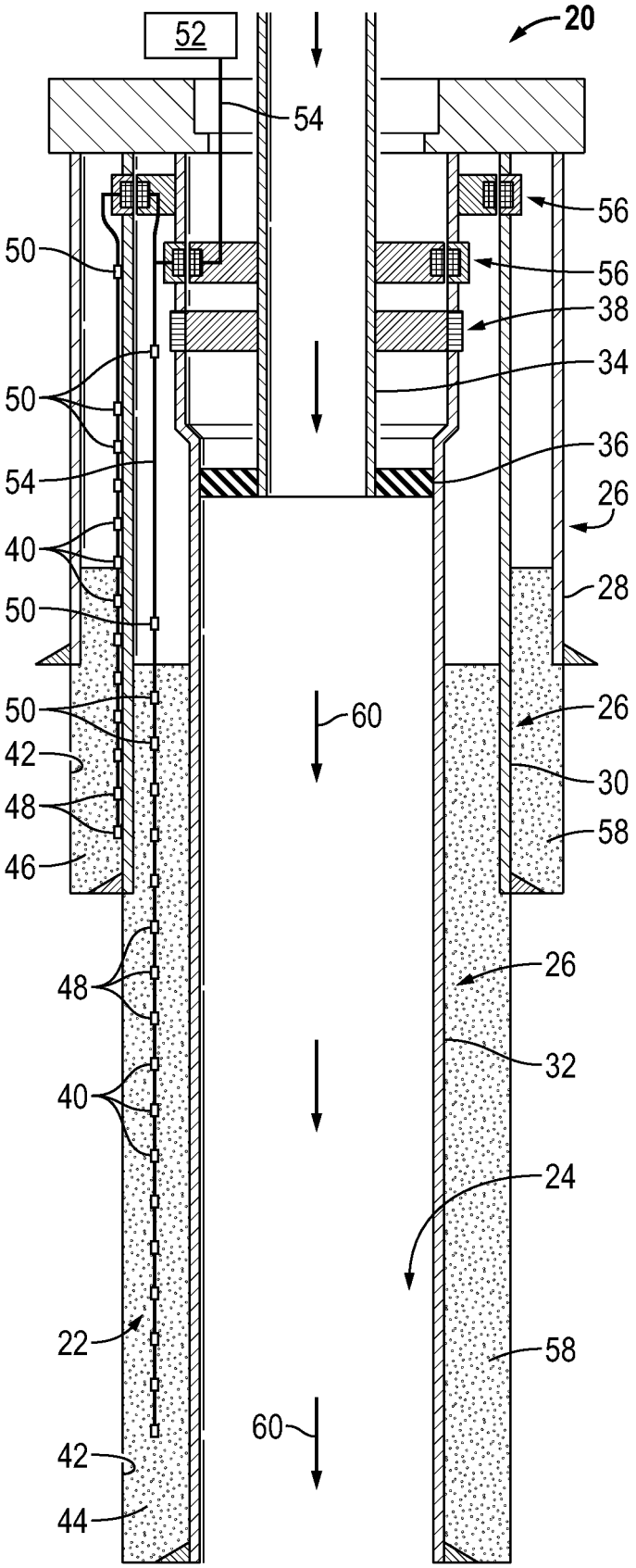
FIG. 1 is an illustration of an example of a borehole system employing an array of sensors positioned in an annulus around a casing, according to an embodiment of the disclosure.

Referring generally to FIG. 1, a well system 20 is illustrated as comprising a sensing system 22 positioned downhole in a borehole 24, e.g. a wellbore, to detect parameters downhole. In this embodiment, the well system 20 comprises tubing 26 which may be in the form of a well casing. By way of example, the casing 26 may comprise a plurality of concentrically positioned casings or casing sections, such as outer casing 28, intermediate casing 30, and inner casing 32. Additionally, a work string 34 may be deployed downhole into the casing 26, e.g. into inner casing 32, and sealed to an interior of the inner casing 32 via a pack off 36, e.g. a packer. The work string 34 also may comprise a variety of other components, such as an indexing casing coupling 38 used for depth correlation.

According to an embodiment, sensing system 22 comprises an array of sensors 40 deployed outside of the casing 26 between the casing 26 and a surrounding borehole wall 42. In the specific embodiment illustrated, the array of sensors 40 comprises sensors 40 deployed in an annulus 44 surrounding inner casing 32 and an annulus 46 surrounding intermediate casing 30. However, the sensors 40 may be deployed in a single annulus or in additional annuli. In some applications, the array of sensors 40 may comprise a temperature sensor bridal or bridals having temperature sensors 48. However, the array of sensors 40 may comprise other types of sensors 50, including strain measurement sensors, pressure sensors, electromagnetic seismic sensors, constituent sensors, e.g. CO2 sensors and H2S sensors, and/or other sensors for detecting desired parameters.

The array of sensors 40 may be communicatively coupled with a control system 52, e.g. a surface control, via communication lines 54 and at least one inductive coupler system 56. By way of example, the communication lines 54 may comprise electrical conductors, e.g. electric cables, which extend to the inductive coupler system 56 along an exterior of the casing 26 and from the inductive coupler system 56 to the control system 52 along an interior of the same casing 26. However, other types of communication lines 54, e.g. fiber optic communication lines or wireless communication lines, may be employed as well as combinations of different types of communication lines. In the specific example illustrated, the inductive coupler system 56 comprises a plurality of inductive coupler systems 56 positioned to communicate signals across both intermediate casing 30 and inner casing 32.

In an operational example, cement 58 is pumped downhole through an interior of the work string 34 and through an interior of the casing 26, as indicated by arrows 60. The cement 58 flows downwardly and then around the bottom of the casing 26 before flowing upwardly into the annulus surrounding the casing 26 to create an annular region of cement 58. In the illustrated example, the cement flows upwardly into both annulus 44 surrounding inner casing 32 and annulus 46 surrounding intermediate casing 30. The cement 58 moves upwardly until it covers at least some of the sensors 40, thus cementing those sensors 40 in place within the corresponding annulus.

For example, temperature sensors 48 may be covered by the cement 58 such that the temperature sensors 48 may be used to monitor curing of the cement 58. The data from temperature sensors 48 and other sensors 40 may be transmitted to the control system 52 in real-time via at least one inductive coupler system 56. The real-time capability enables monitoring of the curing process (and/or other processes) as they occur to enable immediate verification of appropriate curing and/or other desired process results.

Figure 2:
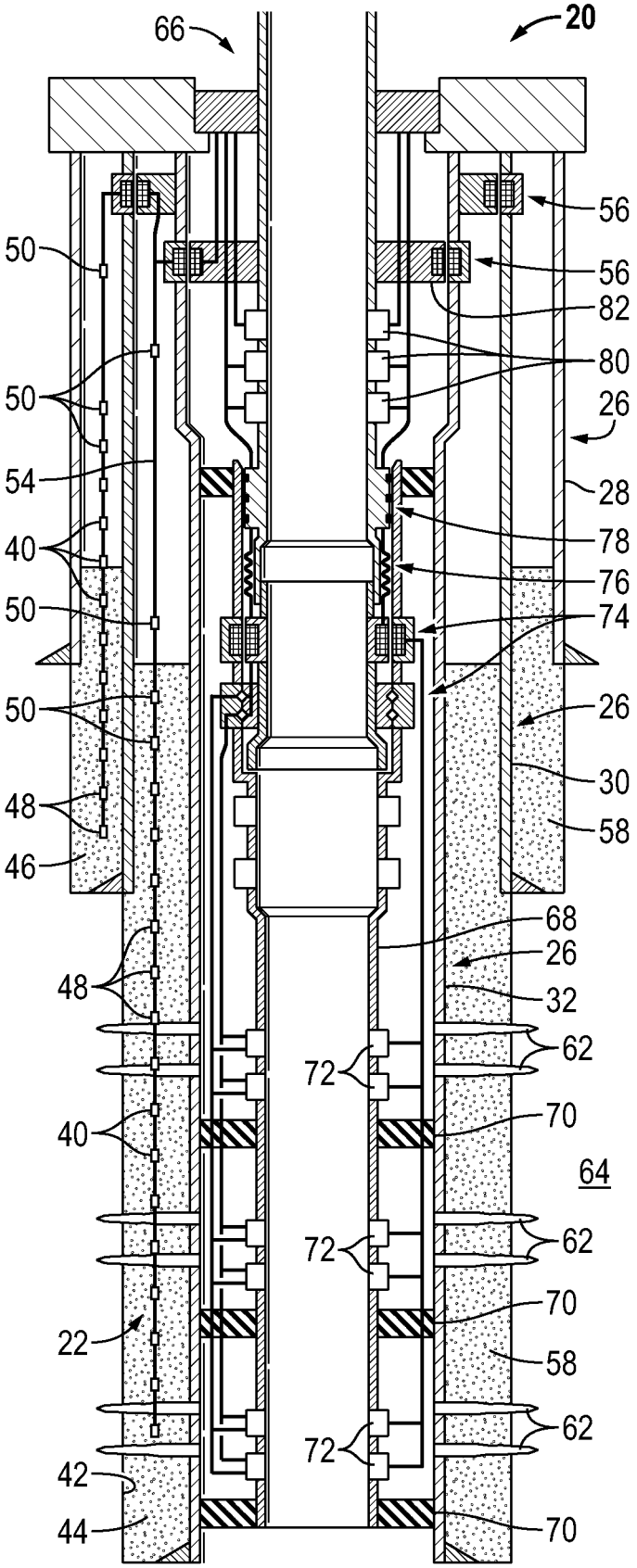
FIG. 2 is another illustration of an example of a borehole system employing an array of sensors positioned in an annulus around a casing in combination with a completion system deployed within the casing, according to an embodiment of the disclosure.

After cement 58 is delivered downhole, the work string 34 is removed and perforations 62 may be formed through casing 26, through the cured cement 58, and into a surrounding formation 64. Subsequently, a completion 66 may be deployed downhole within casing 26, as illustrated in FIG. 2. The components of completion 66 may vary substantially depending on the environment and intended well application, e.g. hydrocarbon fluid production application. By way of example, the completion 66 may comprise a tubing 68 and a plurality of packers 70 which may be set against the surrounding casing 26 to create well zones along the borehole 24. The completion 66 also may comprise a variety of well zone related devices 72, e.g. flow control devices and sensors, deployed in the various well zones. The completion 66 also may comprise other components, such as a hydraulic wet connects 74, a non-sealed contraction joint 76, a ported seal assembly 78, uphole sensors or flow control devices 80, inductive coupler elements 82, and/or various other components or systems. The specific components and arrangements of components along completion 66 are selected to facilitate desired production operations, well servicing operations, and/or other well related operations.

Once cement 58 is cured and completion 66 is deployed downhole, the array of sensors 40 may be used to perform various monitoring operations. For example, the temperature sensors 48 (or other types of sensors) covered, e.g. enclosed, in cement 58 may be used to monitor the integrity of the cement. If cracks, deterioration, or other defects occur in the cement, the temperature sensors 48 and/or other sensors 40 can output data in real-time to control system 52 so as to alert an operator to potential problems as they occur.

Other types of sensors 40, e.g. constituent sensors which detect CO2, H2S, and/or other constituents indicative of changes in the well operation, also may be used to output data in real-time to control system 52. In some applications, for example, a degradation of the cement 58 in the annulus surrounding casing 26 may allow leakage of CO2 which can be detected by appropriate CO2 sensors disposed within the cement 58. Similarly, a variety of strain sensors 40 may be employed to determine strain which occurs along the cured cement 58 and/or along an exterior of the casing 26. Some of these other sensor types are discussed in greater detail below.

Figure 3:
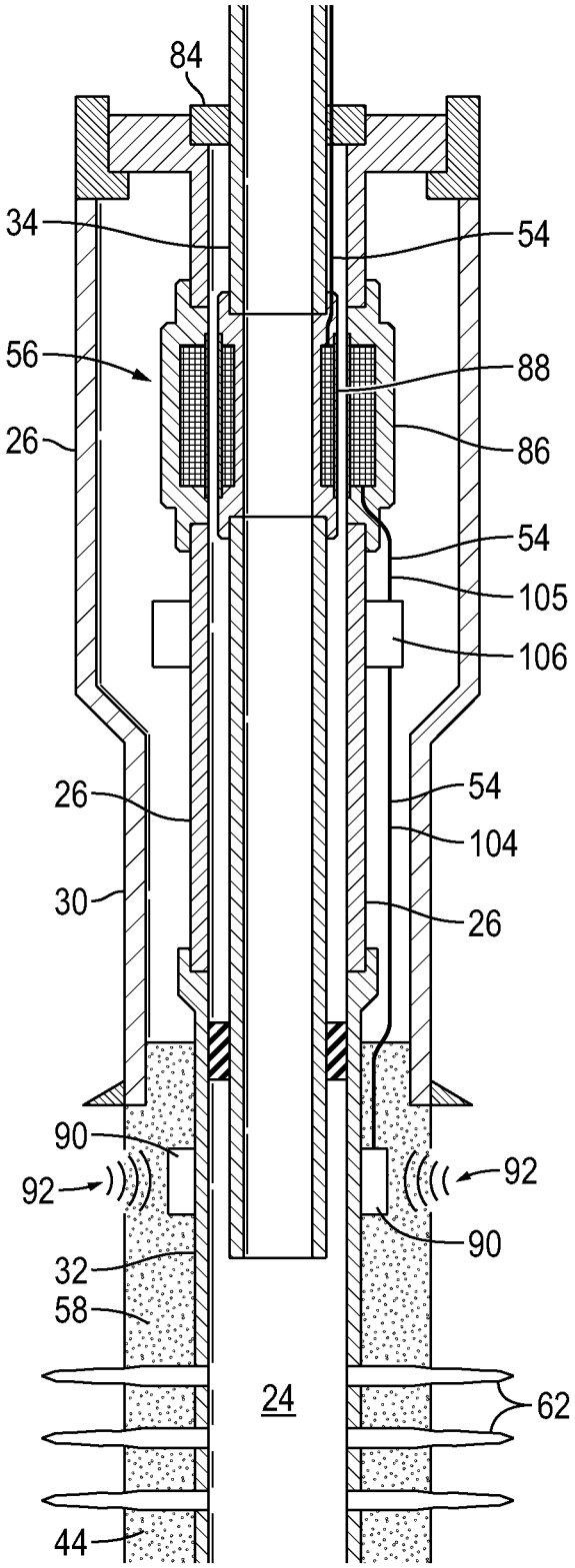
FIG. 3 is an illustration of an example of an inductive coupler system which may be used in a seismic application having electromagnetic seismic sensors disposed in an annulus around the tubing, according to an embodiment of the disclosure.

Referring generally to FIG. 3, an embodiment of inductive coupler system 56 is illustrated. In this example, the inductive coupler system 56 is positioned to wirelessly convey signals, e.g. data and/or power signals, between an exterior of casing 26 and an interior of casing 26. By way of example, the inductive coupler system 56 may be coupled along the inner casing 32, e.g. production casing, suspended from intermediate casing 30 via a tubing hanger 84.

The inductive coupler system 56 may comprise a first inductive coupler member 86, e.g. a female inductive coupler member, on an outside of the inner casing 32 and a second inductive coupler member 88, e.g. a male inductive coupler member, on an inside of the inner casing 32. In this example, the first inductive coupler member 86 is connected with the section of communication line 54 routed along the exterior of the casing to sensors 40 deployed in the surrounding annulus 44. At least some of these sensors 40 may be covered in cement 58 deployed into the annulus 44 during a cementing operation. Additionally, the second inductive coupler member 88 may be connected with the section of communication line 54 routed along the interior of the casing to, for example, control system 52. In the illustrated example, the second or inner inductive coupler member 88 is mounted along work string 34 which is in the form of production tubing. However, inductive coupler members 86, 88 may be mounted along other types of tubing and/or other types of well components depending on the specifics of a given application.

The inductive coupler system 56 may be used in a variety of applications. For example, the inductive coupler system 56 may be used to convey signals across the corresponding casing 26 during seismic applications. As illustrated, the first inductive coupler member 86 may be connected with sensors 40 comprising one or more electromagnetic seismic sensors 90, e.g. geophones, positioned to detect seismic signals 92. As further illustrated, the seismic sensors 90 may be disposed in the cement 58 and within the annulus 44 along the exterior of casing 32. However, the first inductive coupler member 86 may be connected to numerous other types of sensors 40, as further illustrated in FIG. 4. By way of example, sensors 40 may further comprise deep look electromagnetic sensors 94, resistivity sensors 96, temperature sensors 48, constituent sensors 98, e.g. CO2 and H2S sensors, strain sensors 100, pressure sensors 102, and/or other suitable sensors 40.

Figure 4:
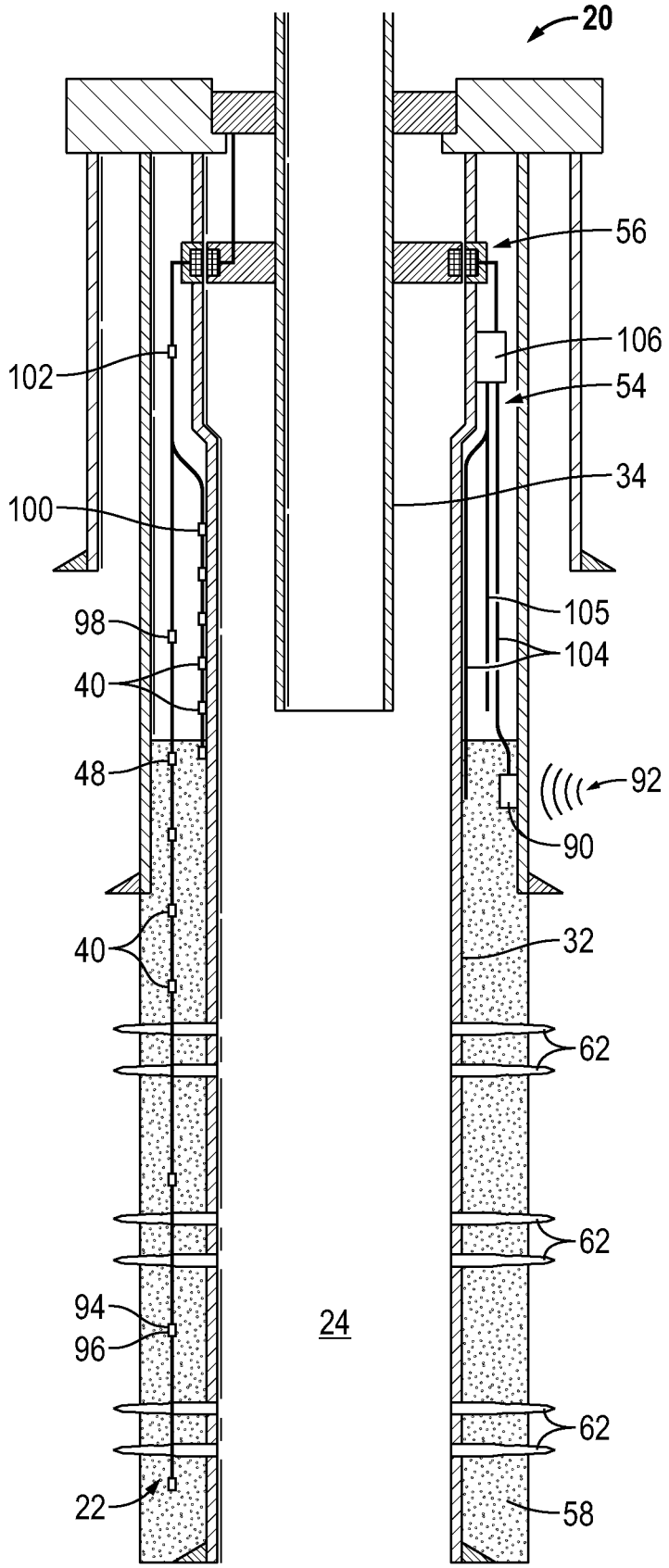
FIG. 4 is an illustration of another example of a borehole system employing an array of sensors positioned in an annulus around a casing in which the sensors are used in a seismic application, according to an embodiment of the disclosure.

In the embodiment illustrated in FIGS. 3 and 4, the communication lines 54 may further comprise an optical fiber 104 coupled to certain sensors 40, such as seismic sensors/geophones 90. The optical fiber 104 may be coupled with a laser and electronics cartridge 106 which is also coupled with first inductive coupler member 86 of inductive coupler system 56. Depending on the application, the communication lines 54 also may comprise electrical conductors, e.g. electric cables 105, coupled between the inductive coupler system 56 and the cartridge 106 and sometimes between the cartridge 106 and various downhole sensors 40. In some applications, the communication line 54 comprises an electric line to provide power to sensor(s) 90, e.g. geophones, and the communication line 54 further comprises an optical fiber optic line which is used for communicating and transmitting data at high speed between the sensor or sensors 90 and the laser and electronics cartridge 106. The cartridge 106 processes the raw optical data to engineering units. In this example, the communication line 54 further comprises an electric cable which connects cartridge 106 to inductive coupler member 86, and the engineering data are transmitted from the cartridge 106 to the female inductive coupler member 86 via the electric cable.

Figure 5:
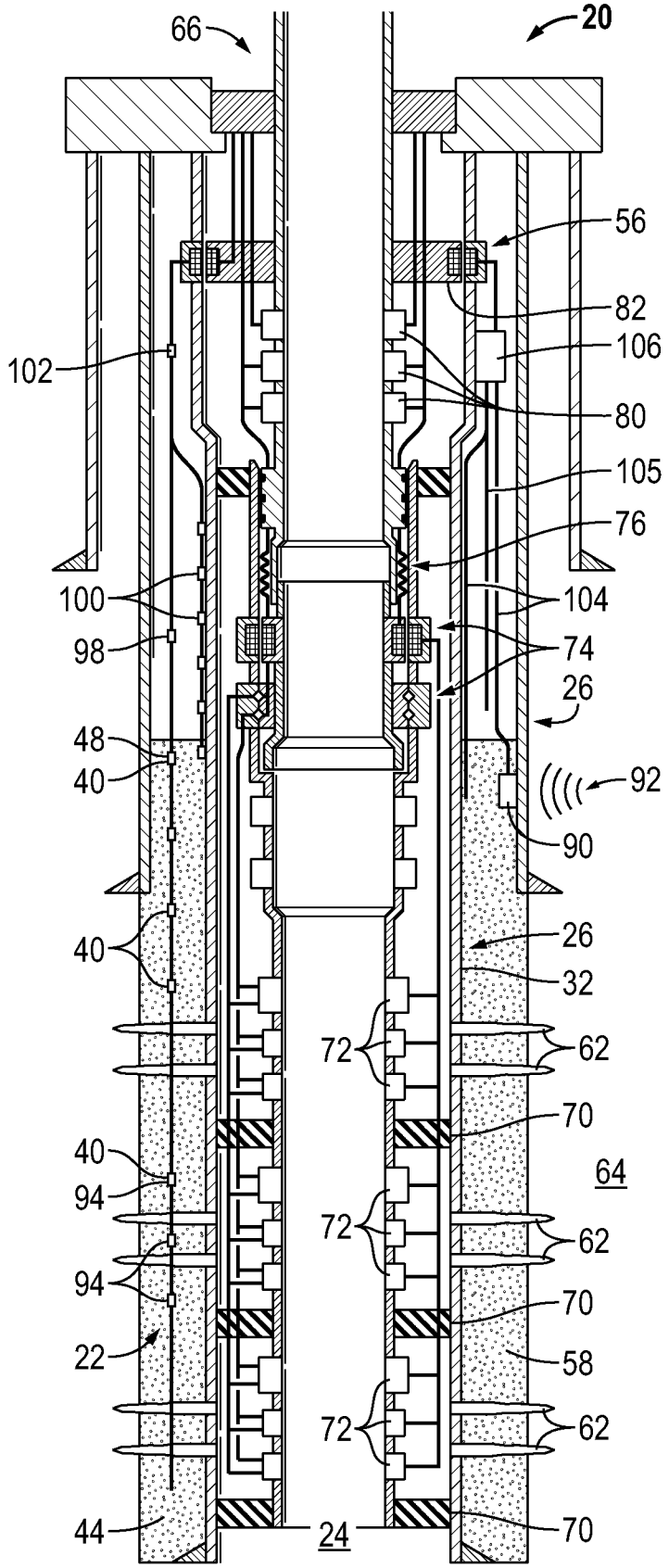
FIG. 5 is another illustration of an example of a borehole system employing an array of sensors positioned in an annulus around a casing in combination with a completion system deployed within the casing, according to an embodiment of the disclosure.

Referring generally to FIG. 5, an embodiment is illustrated in which sensors 40 comprise the electromagnetic seismic sensors 90 and deep look electromagnetic sensors 94 for use in seismic applications, e.g. seismic exploration. In this embodiment, however, completion 66 has been deployed within casing 26, e.g. within inner casing 32, to accommodate a production application. By way of example, completion 66 may be used in a variety of hydrocarbon production applications to facilitate production of hydrocarbon-based fluids from formation 64. However, many other types of completions and/or completion components may be used for a given application.

Regardless, the various sensors 40 (including the temperature sensors 48 and other sensors 40 which may be embedded in cement 58) enable continuous monitoring of cement integrity and/or other parameters related to operation of the well system 20. The inductive coupler system or systems 56 enable the transfer of signals from the annular regions outside of the casing(s) 26 to internal communication lines for transfer to control system 52 and/or other control systems or data collection systems.

In the embodiments illustrated in FIGS. 4 and 5, the well system 20 is designed for micro seismic and electromagnetic deep look seismic applications. In these applications, the communication lines 54 may comprise various optical fibers 104 and electrical conductors/cables 105. By way of example, fiber-optic cables 104 may be coupled with temperature sensors 48 and/or constituent sensors 98. Additionally, fiber optic cables 104 may be coupled with casing strain sensors 100 to measure strain along an exterior of the corresponding casing 26. Some of the communication lines 54 also may comprise both optical fibers and electric cables for communicating signals to and/or from various downhole sensors 40 deployed in an annulus along the exterior of a given casing 26.

Figure 6:
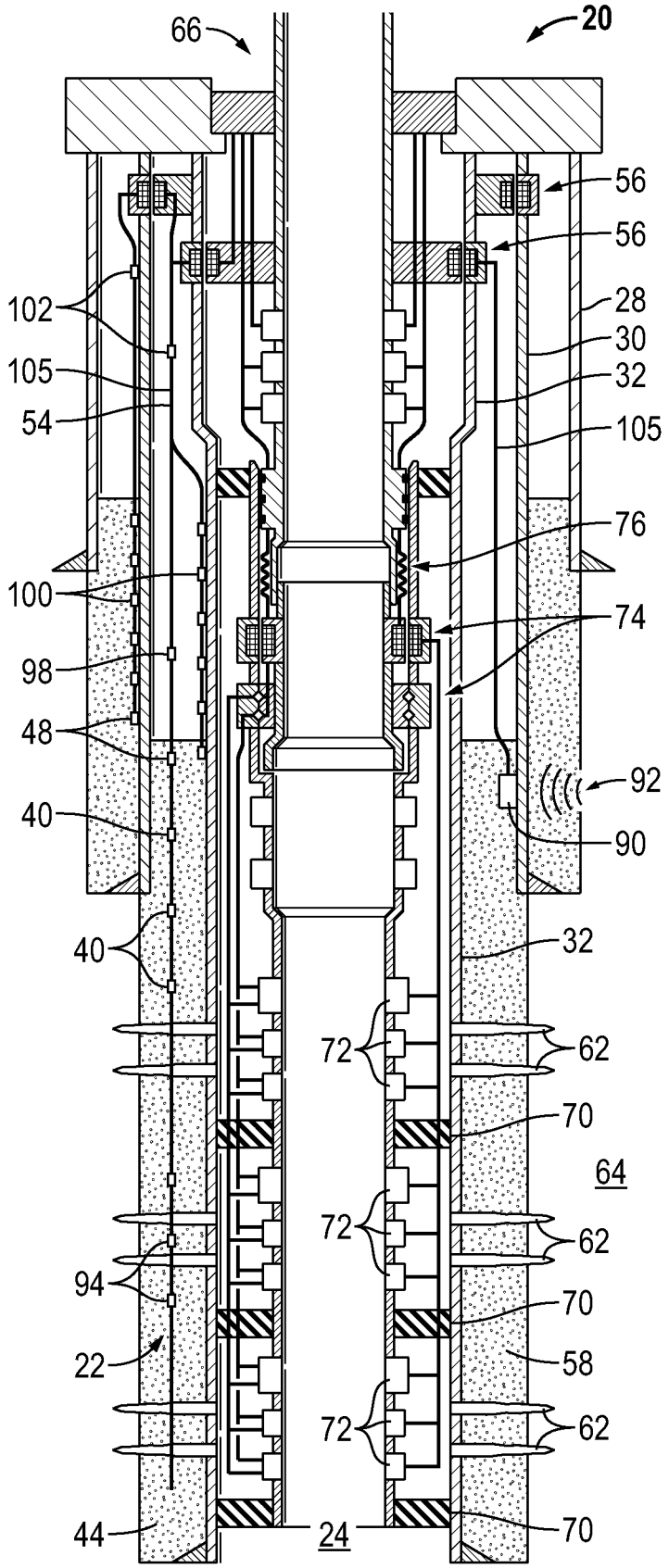
FIG. 6 is another illustration of an example of a borehole system employing an array of sensors positioned in an annulus around a casing in combination with a completion system deployed within the casing, according to an embodiment of the disclosure.

In some embodiments, however, communication lines 54 may comprise electric cables 105. As illustrated in the embodiment of FIG. 6, for example, the laser and electronics cartridge 106 is omitted and electric cables 105 are used in place of the optical fiber cables 104. For example, electric cables 105 may be coupled directly between the inductive coupler system or systems 56 and the corresponding sensors 40, such as seismic sensors/geophones 90, deep look electromagnetic sensors 94, temperature sensors 48, constituent sensors 98, strain sensors 100, and pressure sensors 102.

Figure 7:
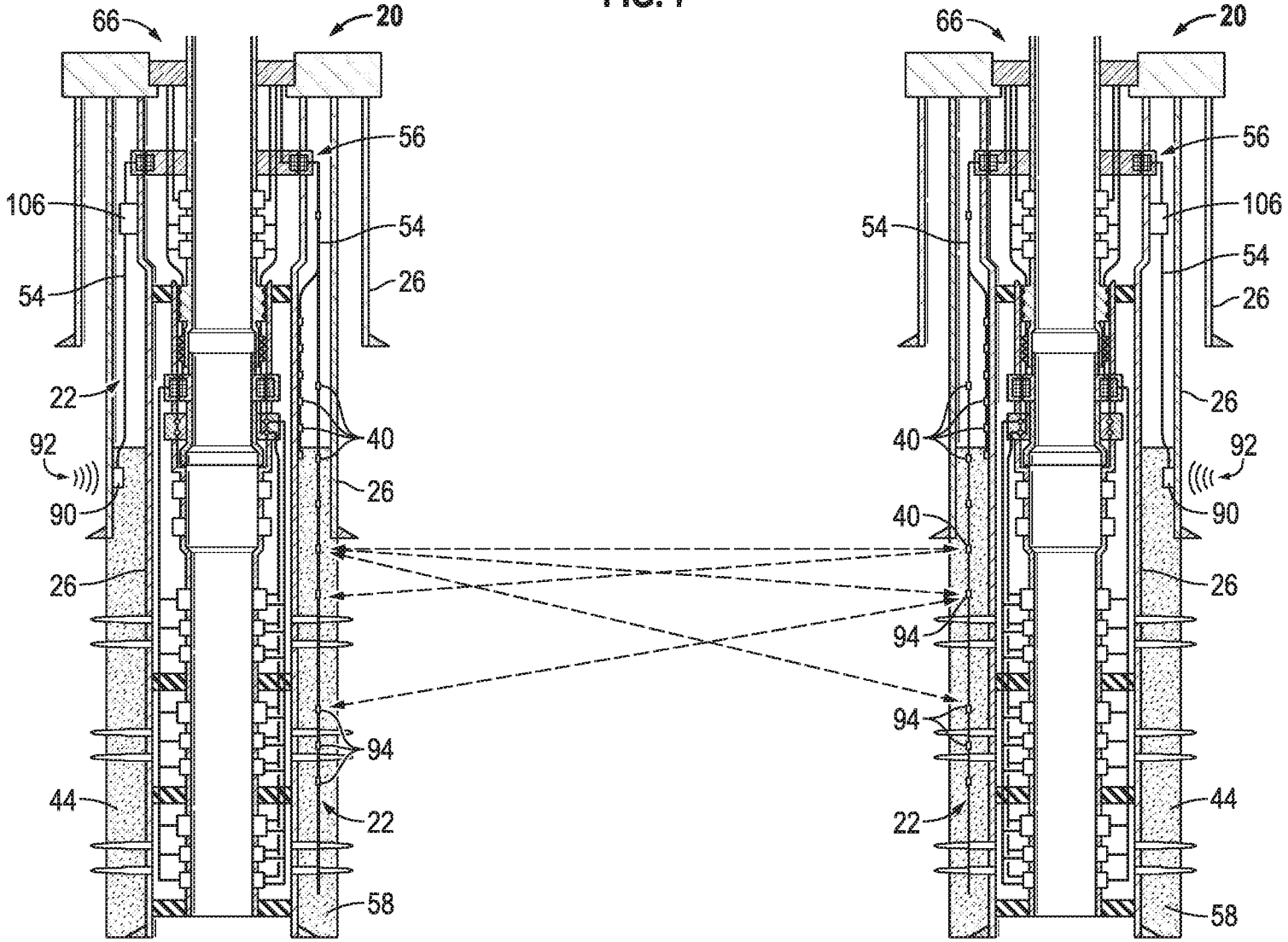
FIG. 7 is another illustration of an example of a borehole system employing an array of sensors positioned in an annulus around a casing and used for cross well monitoring, according to an embodiment of the disclosure.
Figure 8:
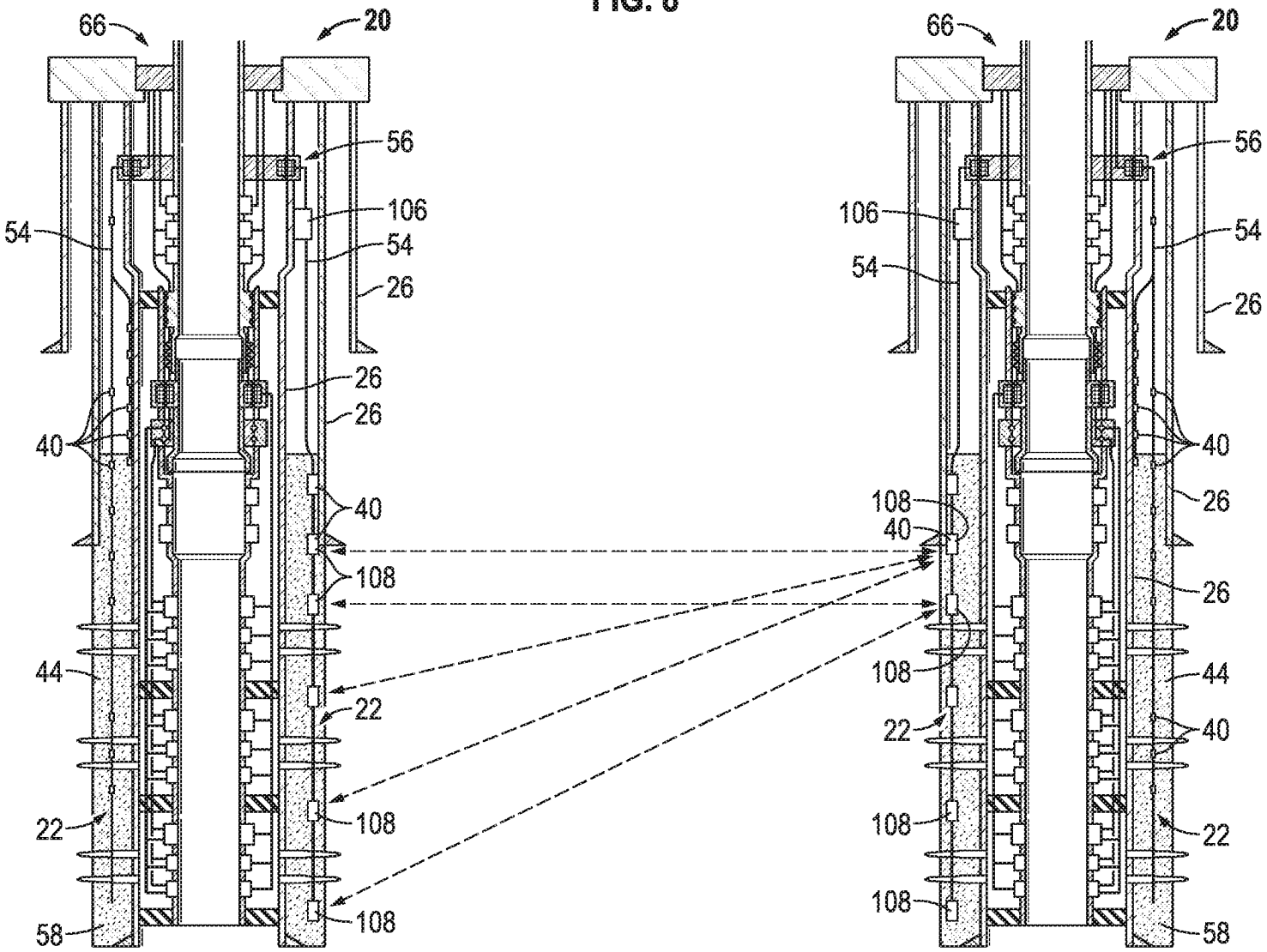
FIG. 8 is another illustration of an example of a borehole system employing an array of sensors positioned in an annulus around a casing and used for cross well seismic imaging, according to an embodiment of the disclosure.

Referring generally to FIG. 7, another embodiment is illustrated in which sensors 40 are deployed externally of casing 26 in an annulus, e.g. annulus 44, between the casing 26 and the surrounding borehole wall 42. In this example, a pair of well systems 20 is provided, and each well system 20 is disposed in its corresponding borehole 24. The array of sensors 40 comprises a plurality of deep look electromagnetic sensors 94. As illustrated, the electromagnetic sensors 94 associated with each well system 20 may be oriented toward the other well system 20 across formation 64 for cross well monitoring. The electromagnetic sensors 94 may be positioned within cement 58 in each of the boreholes 24. In some applications, the cross well monitoring may be performed between additional wells and well systems 20.

In another application, the sensors 40 may comprise seismic imaging sensors 108. The seismic imaging sensors 108 may be used in cross well seismic imaging applications which are useful in certain types of seismic exploration. The seismic imaging sensors 108 of separate well systems 20 may be oriented toward each other as illustrated to facilitate the seismic operation. As with the previous embodiment, the cross well seismic imaging may be performed between additional wells and well systems 20.

Depending on the application, various additional sensors 40 or combinations of sensors 40 may be positioned externally of casing 26 for providing information on a variety of parameters and/or events which occur in downhole environments. For example, sensors 40 may be selected and positioned to perform distributed vibration monitoring, water breakthrough detection, scale and asphaltine buildup detection, fluid characterization, tracer detection for flow sensing, sand count and gravel pack integrity monitoring, H2S profiling, and/or other parameter and event monitoring. The array of sensors 40 deployed externally of the pertinent casing 26 and the use of the one or more inductive coupler systems 56 facilitate communication of data in real-time regarding the various parameters and events monitored downhole.

Figure 9:
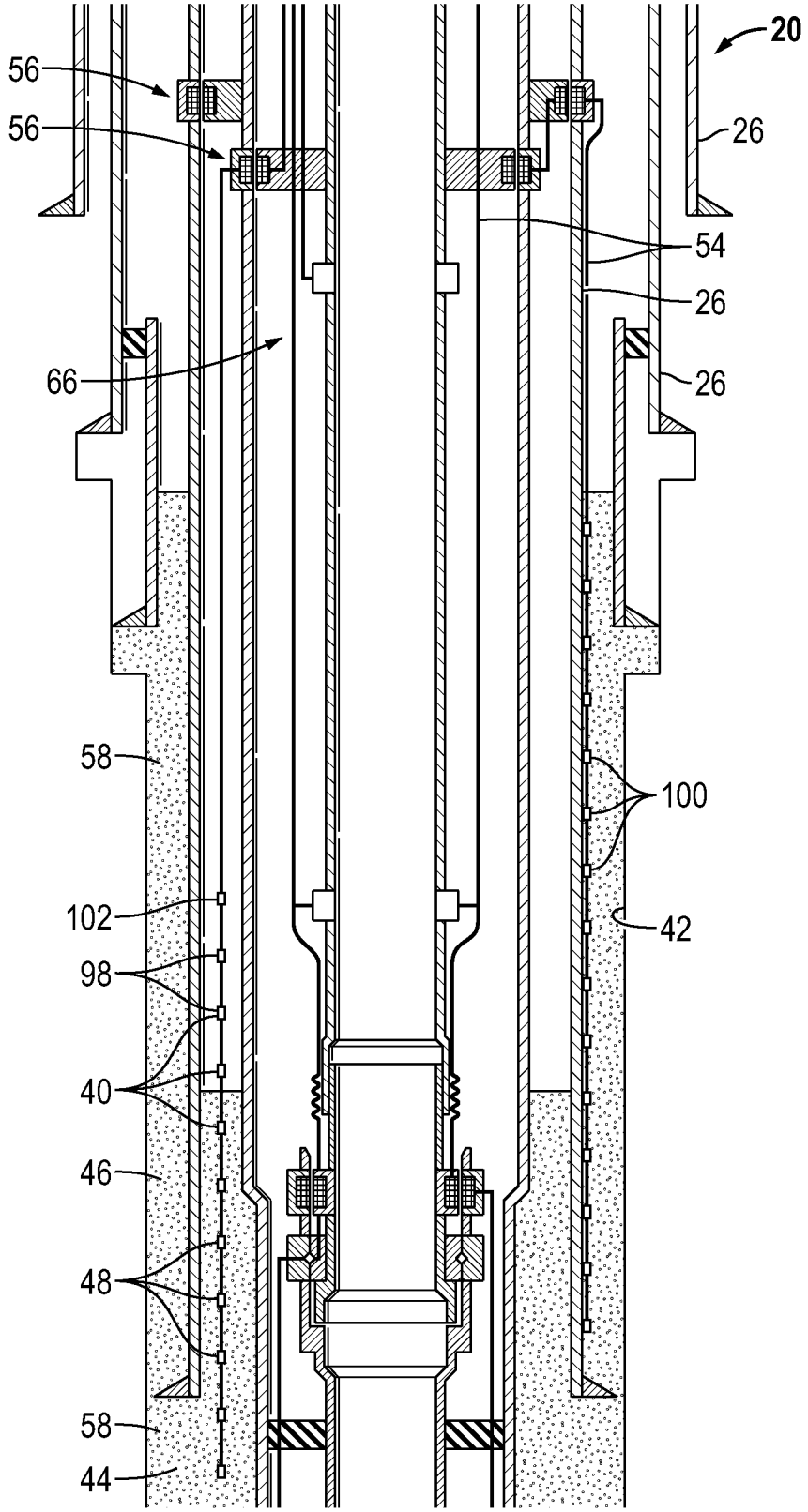
FIG. 9 is another illustration of an example of a borehole system employing an array of sensors positioned in an annulus around a casing in combination with a completion system deployed within the casing, according to an embodiment of the disclosure.

In the embodiment illustrated in FIG. 9, for example, the array of sensors 40 is employed externally of a corresponding casing 26 and used in combination with at least one inductive coupler system 56 to provide a pre-salt well integrity monitoring system. In this example, sensors 40 are deployed in both annulus 44 and annulus 46 along the exterior of inner casing 32 and intermediate casing 30, respectively. The sensors 40 in each annulus 44, 46 are coupled with a corresponding inductive coupler system 56 to monitor the integrity of the well at a plurality of locations post curing of the cement 58. In this example, at least some of these sensors 40 may be covered in the cement 58, e.g. embedded in the cement 58. In the pre-salt well integrity application illustrated, temperature sensors 48 may be embedded in the cement 58 along annulus 44 while casing strain sensors 100 are mounted along annulus 46.

Figure 10:
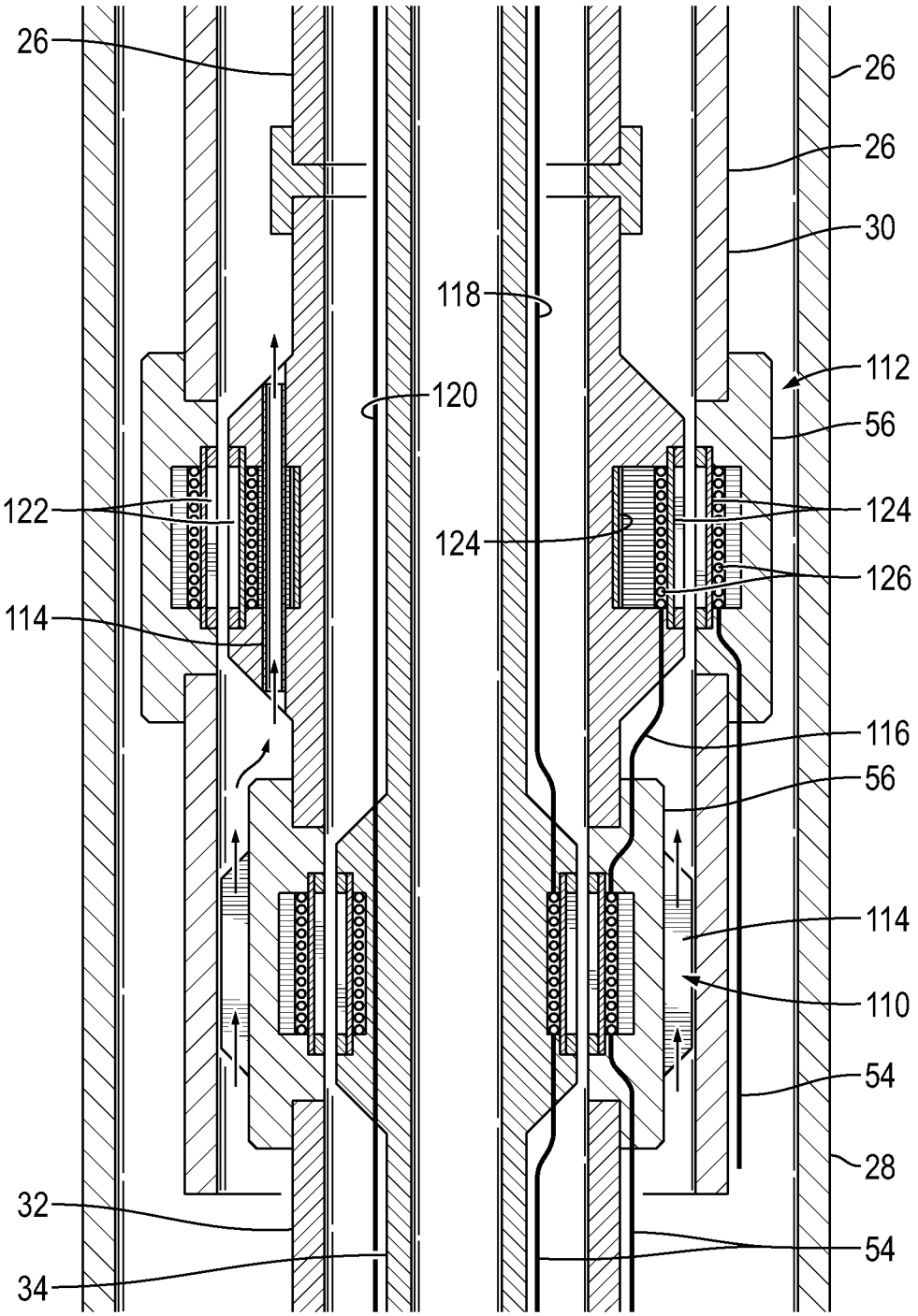
FIG. 10 is an illustration of an example of a cross tubing communication system employing a plurality of inductive coupler systems, according to an embodiment of the disclosure.

Referring generally to FIG. 10, an embodiment is illustrated which employs a plurality of the inductive coupler systems 56. By way of example, an inner inductive coupler system 110 of the plurality of inductive coupler systems 56 may be positioned to communicate signals across inner casing 32. Similarly, an outer inductive coupler system 112 of the plurality of inductive coupler systems 56 may be positioned to communicate signals across intermediate casing 30. However, the plurality of inductive coupler systems 56 may be positioned along other casings/tubings and at other positions along the well system 20.

In the example illustrated in FIG. 10, each inductive coupler system 110, 112 comprises the outer inductive coupler member 86 and the corresponding inner inductive coupler member 88. Additionally, each inductive coupler system 110, 112 comprises fluid bypass channels 114 to allow for fluid flow longitudinally past the inductive coupler systems. In some applications, signals are wirelessly communicated across casing 30 by outer inductive coupler system 112 and then transferred to the inner inductive coupler system 110 via a communication line section 116, e.g. an electric cable section. The signals may then be wirelessly communicated across casing 32 by inner inductive coupler system 110 for transmission to, for example, control system 52 via the appropriate communication line 54. In this example, the inner inductive coupler system 110 also is employed to wirelessly communicate signals received from sensors 40 deployed along annulus 44.

Depending on the application, the inductive coupler systems 110, 112 may accommodate passage of other types of communication lines. In the illustrated embodiment, for example, an additional communication line 118 is illustrated as passing longitudinally through the inner inductive coupler system 110 for transmitting electric and/or optical signals. Additionally, hydraulic communication lines 120 or other suitable communication lines may be routed longitudinally through inner inductive coupler system 110, as illustrated, and/or through outer inductive coupler system 112.

Specific inductive coupler systems 56 also may comprise other components selected for environmental considerations and/or operational considerations. For example, at least one of the inductive coupler systems 56 may comprise a slotted metal cage 122 and a sheet-metal barrier 124 to protect coils 126 and/or other components of the inductive coupler systems 56.

Depending on the application, many types of sensing systems 22 may be utilized in a variety of boreholes 24. The sensing systems 22 may be used in well and non-well related applications to facilitate monitoring of parameters/events which occur outside of a tubing, e.g. casing. The sensors 40 may be positioned in an individual annulus or they may be positioned in a plurality of annuli formed by a plurality of concentric casings 26 with each casing 26 having a unique diameter. The use of inductive couplers in the manner described above, enables monitoring of such regions with a variety of sensors and in real-time. In well applications, many types of completions, production strings, and/or other components and systems may be incorporated into the overall structure according to the desired operations to be performed. The sensors 40 may be used to monitor curing of cement along the exterior annuli and then for monitoring the integrity of the cement post curing. However, a variety of other types of sensors may be used to detect and monitor parameters and events occurring in difficult to reach locations, e.g. external annuli. The number, components, and configurations of the inductive coupler systems also may be adjusted according to the criteria of a given monitoring application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for sensing downhole, comprising:

a casing deployed in a borehole;

an array of sensors deployed outside of the casing and between the casing and a borehole wall;

a second casing concentrically disposed within the casing;

a second array of sensors deployed between the casing and the second casing such that some of the sensors in the second array of sensors overlap some of the sensors in the array of sensors, at least a portion of the array of sensors and the second array of sensors being disposed in cement;

a first inductive coupler system having a first inductive coupler member connected to the array of sensors and disposed on an outside of the casing and a second inductive coupler member on an inside of the casing;

a second inductive coupler system having a first inductive coupler member connected to the second array of sensors and disposed on an outside of the second casing and a second inductive coupler member on an inside of the second casing;

a surface control coupled in communication with the first inductive coupler system and the second inductive coupler system, the array of sensors and the second array of sensors providing real-time communication of data to the surface control; and a completion deployed downhole within the casing and the second casing, at least a portion of the array of sensors and the second array of sensors remaining enclosed in cement while monitoring the integrity of the cement after the completion is deployed within the casing and the second casing.

2. The system as recited in claim 1, wherein the array of sensors comprises a plurality of temperature sensors positioned in the cement to enable monitoring of the cement during curing.

3. The system as recited in claim 1, wherein array of sensors comprises a pressure sensor.

4. The system as recited in claim 1, wherein array of sensors comprises a strain sensor.

5. The system as recited in claim 1, wherein array of sensors comprises a $CO_2$ sensor.

6. The system as recited in claim 1, wherein array of sensors comprises an $H_2S$ sensor.

7. The estimate as recited in claim 1, wherein the plurality of sensors comprises a plurality of electromagnetic sensors employed in a seismic operation.

8. The system as recited in claim 1, wherein signals are communicated from the array of sensors to the surface control along at least one of an electric communication line and a fiber optic communication line.

9. A method for sensing in a borehole, comprising:

deploying a casing in a borehole;

positioning a plurality of sensors in an annulus along an exterior of the casing;

locating additional sensors between the casing and an internal casing such that at least some of the additional sensors are located radially inward of and overlap at least some sensors of the plurality of sensors;

routing a communication line from the plurality of sensors to an interior of the casing and from the additional sensors to an interior of the internal casing via a plurality of inductive coupler systems;

cementing the annulus such that at least some sensors of both the plurality of sensors and the additional sensors are cemented in place and enclosed in cement;

using the plurality of sensors to monitor curing of cement deployed in the annulus during cementing of the annulus;

deploying a completion downhole within the casing and the internal casing; and using at least a portion of the plurality of sensors and the additional sensors to monitor integrity of the cement following curing of the cement.

10. The method as recited in claim 9, wherein positioning comprises positioning a plurality of temperature sensors and cementing comprises covering the plurality of temperature sensors with cement.

11. The method as recited in claim 10, wherein using comprises using the plurality of temperature sensors to monitor curing of the cement.

12. The method as recited in claim 11, wherein using comprises monitoring curing of the cement in real-time.

13. The method as recited in claim 9, wherein routing comprises routing a fiber optic line from at least one sensor of the plurality of sensors to a laser and electronics cartridge.

14. The method as recited in claim 13, wherein routing further comprises routing an electric line from the plurality of inductive coupler systems to the laser and electronics cartridge and from the laser and electronics cartridge to the at least one sensor.

15. A method, comprising:

deploying a plurality of concentric tubings downhole in a wellbore;

performing a cementing operation to position cement concentrically in at least two annuli formed by the plurality of concentric tubings;

monitoring parameters of the cementing operation with a plurality of sensors positioned in the at least two annuli such that at least some of the sensors positioned in at least one of the at least two annuli overlap at least some of the sensors positioned in another of the at least two annuli;

using a plurality of inductive couplers for transferring data to enable outputting of the data from the plurality of sensors and from within each of the at least two annuli to a surface location in real-time;

allowing cement from the cementing operation to cure in a manner enclosing at least a portion of the plurality of sensors positioned in each annulus of the at least two annuli to establish cement enclosed sensors; and employing the cement enclosed sensors to monitor the integrity of the cement after the cement is cured.

* * * * *